United States Patent [19]

Scott et al.

[11] 4,068,341

[45] Jan. 17, 1978

[54] TRANSPARENT BELT LIFTER MOUNTING FOR VACUUM CLEANERS

[75] Inventors: Ernest R. Scott, Mayfield Heights; Charles H. MacFarland, Rocky River, both of Ohio

[73] Assignee: The Scott & Fetzer Company, Cleveland, Ohio

[21] Appl. No.: 661,834

[22] Filed: Feb. 26, 1976

[51] Int. Cl.[2] ..... A47L 5/32

[52] U.S. Cl. ..... 15/339; 15/332; 15/390

[58] Field of Search ..... 15/332, 333, 334, 335, 15/336, 337, 339, 390

[56] References Cited

U.S. PATENT DOCUMENTS

| | | | |
|---|---|---|---|
| 1,347,166 | 7/1920 | Kirby | 15/337 |
| 3,049,744 | 8/1962 | MacFarland | 15/390X |
| 3,646,632 | 3/1972 | MacFarland | 15/332 X |

*Primary Examiner*—Christopher K. Moore
*Attorney, Agent, or Firm*—McNenny, Pearne, Gordon, Gail, Dickinson & Schiller

[57] ABSTRACT

An upright vacuum cleaner is disclosed providing a belt lifter operable to connect and disconnect the floor brush belt from the motor drive shaft. The belt lifter combines a viewing window allowing the user to easily observe the position of the belt and/or its operation. The belt lifter is provided with a tubular shaft portion pivotally mounted in the forward wall of the floor nozzle housing and a transparent plastic cup shaped member positioned within the tubular shaft section in which the end wall provides the viewing window. A face plate is keyed to the tubular shaft section to rotate the belt lifter for connecting and disconnecting the belt. A pair of triangular shaped snap rings secure the belt lifter assembly in its assembled position.

9 Claims, 3 Drawing Figures

TRANSPARENT BELT LIFTER MOUNTING FOR VACUUM CLEANERS

BACKGROUND OF THE INVENTION

This invention relates generally to vacuum cleaners of the type providing belt driven floor treatment members such as rotating floor brushes or the like, and more particularly to a novel and improved vacuum cleaner including a belt lifter to allow the connection and disconnection of the belt and incorporating viewing means allowing the user to easily observe the belt position and/or its operation.

PRIOR ART

The U.S. Pat. No. 3,646,632, assigned to the assignee of the present invention, discloses a vacuum cleaner having a belt driven floor brush and including a belt lifter operable to disconnect and connect the belt to the drive motor. Such belt lifters are useful in cleaners in which for any reason it is desired to disconnect the belt from the drive motor. For example, such belt lifters are employed in cleaners which provide nozzles which can be removed to allow installation of other attachments. Such letters patent are incorporated herein by reference.

It is also known to provide a vacuum cleaner with a viewing window which allows a user to visually observe the operation of the belt. Such cleaner, however, does not provide a belt lifter and it is believed that the purpose of the window is to permit observation of the operation of the belt to determine if the belt is broken or so worn that it fails to drive the floor brush.

In cleaners providing belt lifters, the user sometimes inadvertantly operates the cleaner without properly engaging the belt. When this is done, the cleaner efficiency is greatly decreased.

SUMMARY OF THE INVENTION

A vacuum cleaner in accordance with this invention provides a belt lifter which permits the user to connect and disconnect the belt from the motor in combination with viewing means which allow the user to determine if the belt is properly connected for cleaner operation. With such structure, the inadvertence use of the cleaner when the belt is not properly connected and operating is easily avoided.

In the illustrated embodiment, the belt lifter is provided with a journal or shaft assembly which supports the lifter on the nozzle housing for rotation about an axis between the first position in which the belt is lifted clear of the motor shaft and a second position in which the belt is connected to such motor shaft. The axis of such journal is substantially aligned with a belt drive portion of the motor shaft. The shaft assembly is tubular and includes a transparent centrally located window through which the viewer can view the position and operation of the belt.

This structure provides, within a single housing opening, both the belt lifter and the viewing window. Further, this structure is arranged so that the viewing window and the face plate are held in position on the shaft portion by a single snap ring for easy assembly and low-cost manufacture. Further, this structure is arranged to provide a pleasing appearance.

These and other features of this invention will become apparent from the following description and drawings wherein.

DETAILED DESCRIPTION OF THE DRAWINGS

Figure 1:
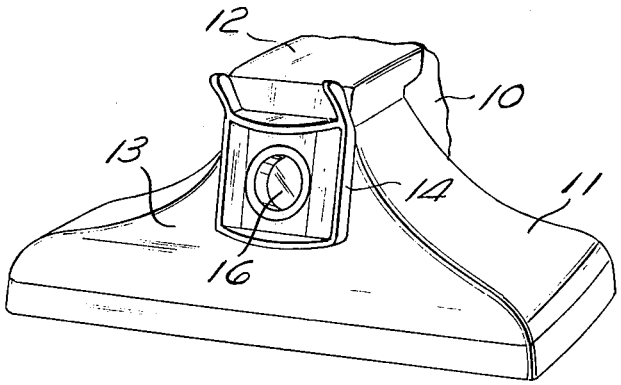
FIG. 1 is perspective view illustrating the nozzle portion of a vacuum cleaner in accordance with this invention.

FIG. 1 illustrates the nozzle portion of a vacuum cleaner incorporating the present invention including a portion of the motor housing 10, the suction nozzle housing 11, and a hinged housing cover plate 12, which, with hearing plate 24 constitutes in cooperation a housing assembly. Journalled on the forward face 13 of the suction nozzle 11 is a face plate 14 which constitutes part of the belt lifting mechanism. Centrally located in the face plate is a viewing window 16 formed of a transparent material so that the user of the cleaner can observe the position and operation of the belt within the housing 11.

Figure 3:
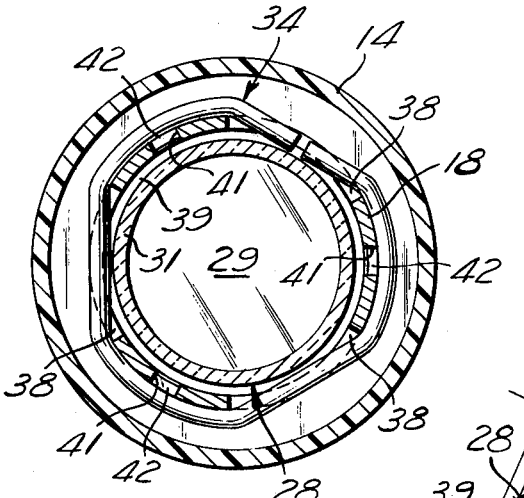
Figure 2:
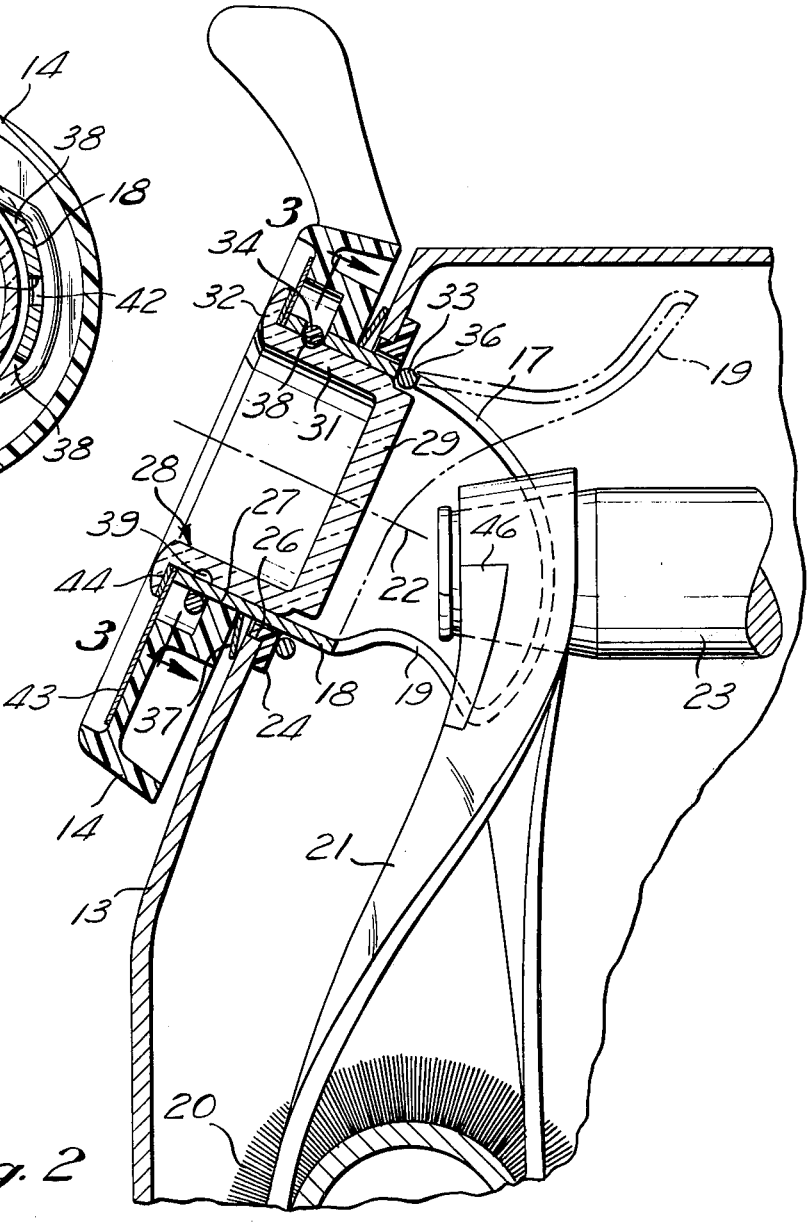
FIG. 2 is an enlarged fragmentary side elevation illustrating the structure of the combination belt lifter and viewing window; and, FIG. 3 is a fragmentary cross section taken along 3—3 of FIG. 2.

Referring to FIGS. 2 and 3, the cleaner includes a belt 21 which connects between a brush 20 and a motor shaft 23. The belt lifting mechanism includes a metal belt lifter member 17 formed with a tubular shaft portion 18, constituting rotatable shaft means, and a rearwardly extending arm 19. The arm is shaped so that it is clear of the belt 21 when in the normal operating position of the cleaner illustrated, and moves to an operated position with pivoted movement, operating to engage the belt 21 and lift it up clear of the motor shaft 23 in the phantom position. In the particular embodiment illustrated, the belt lifter is operated to the phantom position to lift the belt 21 away from the shaft 23 and thereby disconnect the belt so that the nozzle housing 11 can be removed or installed on the motor housing 10, as more fully described in the U.S. Pat. No. 3,646,632 referred to above. When the nozzle housing 11 is installed with the belt lifter arm 19 in the phantom position, the belt freely moves past the end of the shaft 23. The belt is then connected to the shaft by rotating the arm 19 about the axis 22 to the full line position in which the belt is properly connected to the shaft 22.

The shaft portion 18 extends through a flanged bearing ring 24, which is positioned in a circular opening 26 in the face 13 and through an opening 27 formed in the face plate 14. A cup shaped transparent window member 28 is positioned within the shaft portion 18 and provides a transparent end wall or window 29 aligned with the end of the shaft 23 through which the user of the cleaner can view the position of the belt and/or operation. The window member 28 provides a cylindrical side wall 31 which closely fits the shaft portion 18 and extends from the end wall 29 to an outwardly directed flange 32.

A pair of similar triangular shaped snap rings 33 and 34 operate to lock the belt lifter in its assembled position. The snap ring 33 is positioned within three peripherally spaced grooves 36 in the cylindrical portion 18 of the lifter member 17 and engages the inner side of the bearing member 24. Positioned between the forward face 13 of the nozzle 11 and the rearward side of the face plate 14 is a spring washer 37 which functions to pre-load the assembly and prevent looseness. The snap ring 34 is also positioned within three symmetrically located grooves 38 in the shaft portion 18 and performs a dual function of locking the face plate 14 on the shaft 18 and also locks the window member 28 in position. The peripherally spaced extremities of the snap ring 34 engage the forward face of the face plate 14 to lock the face plate and the peripherally spaced minimum radius sections engage an groove 39 in the window member 28 to lock it in position.

The cylindrical portion 18 is formed with three symmetrical key ways 41 which receive integral keys 42, formed on the face plate to lock the plate and lifter member against relative rotation. Consequently, when the face plate is rotated to operate the belt lifter, the arm 19 is caused to rotate between the position in which the belt is properly connected to the shaft 23 and the position in which the belt is disconnected from the shaft.

A thin cover plate 43 is held in place beneath the flange 32 of the window member and functions to cover the mechanism. A metallized ring 44 formed of a plastic material such as mylar, is positioned between the flange 32 and the cover member 43 so that the flange is presented with a metal-like appearance. If desired, indicia may be printed on the ring 44.

In the illustrated embodiment, the forward face of the flange 32 is curved to provide a lens effect, which tends to magnify the ring 44 so that it appears to extend inwardly beyond the outer wall of the cylindrical portion 31 so that the cylindrical wall portion 31 is obscured or de-emphasized in the total appearance of the assembled mechanism.

Because the window 29 is located along the axis 22 in alignment with the end of the shaft 23 and the connected belt 21, the user can easily observe whether or not the belt is properly connected for use. consequently, the likeihood of inadvertent operation of the cleaner with the belt disconnected is substantially eliminated. Further, the operation of the belt can be viewed and if improper operation is occurring because of belt wear or the like, this can be determined. If desired, the belt can be provided with interrupted markings 46 of constrasting color to assist in the observation of the proper operation of the belt.

Although a preferred embodiment of this invention is illustrated, it is to be understood that various modifications and rearrangements may be resorted to without departing from the scope of the invention disclosed and claimed.

What is claimed is:

1. A vacuum cleaner comprising a housing assembly, a powered floor treatment member in said housing assembly, a motor in said housing assembly having a motor shaft, a belt operable to connect said motor shaft to said floor member for driving the latter, and a belt lifter mounted on said housing assembly rotatable about an axis from a first position in which it allows said belt to be connected to said motor shaft and a second position in which it causes said belt to be disconnected from said motor shaft, said belt lifter including rotatable shaft means supporting said belt lifter on said housing assembly for rotation about said axis between said first and second positions, said shaft means including a transparent window allowing a user to observe the position of said within said housing from a location exterior of said housing.

2. A vacuum cleaner as set forth in claim 1 wherein said belt lifter further includes a lifter member providing a tubular portion constituting a part of said rotatable shaft means, and a laterally projecting arm operable to engage said belt, said viewing window being located coaxially with said tubular portion.

3. A vacuum cleaner as set forth in claim 2 wherein said viewing window is provided by a cup shaped transparent member providing an end wall viewing window and a cylindrical wall closely fitting the interior of said shaft portion.

4. A vacuum cleaner as set forth in claim 3 wherein a face plate is positioned around said shaft portion exteriorly of said housing assembly and is locked against rotation with respect to said shaft portion, rotation of said face plate rotating said belt lifter between said first and second positions.

5. A vacuum cleaner as set forth in claim 4 wherein said face plate, lifter member and transparent member are connected by a single connector.

6. A vacuum cleaner as set forth in claim 5 wherein said single connector is a snap ring.

7. A vacuum cleaner as set forth in claim 6 wherein said snap ring is non-circular and fits through openings in said tubular portion, said snap ring providing circumferentially spaced first portions exteriorly of said tubular portion engageable with said face plate and circumferentially spaced second portions interiorly of said tubular portion engaging said cup shaped member.

8. A vacuum cleaner as set forth in claim 7 wherein a second snap ring is removably mounted on said tubular portion within said housing assembly against longitudinal movement relative to said tubular portion, said second snap ring being adapted to bear against the inner surface of said housing assembly to prevent removal of said belt lifter from said housing assembly, removal of said second snap ring from said tubular portion permitting removal of said belt lifter from said housing assembly.

9. A vacuum cleaner as set forth in claim 3 wherein said transparent member is formed with a flange at its outer end faced with a decorative material, said flange being formed with a lens shape to emphasize said decorative material and tending to obscure said cylindrical portion.

* * * * *